US005282597A

United States Patent [19]

Babcock

[11] Patent Number: 5,282,597

[45] Date of Patent: Feb. 1, 1994

[54] SAFETY LINE ANCHORING DEVICE

[75] Inventor: Michael A. Babcock, 3124 Dakota Ave. South, St. Louis Park, Minn. 55416

[73] Assignee: Michael A. Babcock, St. Louis Park, Minn.

[21] Appl. No.: 925,567

[22] Filed: Aug. 4, 1992

[51] Int. Cl.[5] ..... E04G 3/08

[52] U.S. Cl. ..... 248/237; 182/45

[58] Field of Search ..... 248/237; 182/45, 3

[56] References Cited

U.S. PATENT DOCUMENTS

| | | | |
|---|---|---|---|
| 1,113,775 | 10/1914 | Gibson | 248/237 |
| 1,152,685 | 9/1915 | Winn et al. | 248/237 |
| 2,336,144 | 2/1942 | Wickstrom | 248/237 |
| 2,703,688 | 3/1955 | Shuter | 248/237 |
| 3,210,036 | 10/1965 | Owens | 248/237 |
| 3,941,208 | 3/1976 | St. Germain | 182/3 |
| 4,249,713 | 2/1981 | Glynn et al. | 248/237 |
| 4,946,123 | 8/1990 | Albert | 248/237 |
| 5,054,576 | 10/1991 | Glynn | 248/237 |
| 5,092,426 | 3/1992 | Rhodes | 182/3 |
| 5,143,170 | 9/1992 | Hunt et al. | 248/237 X |

FOREIGN PATENT DOCUMENTS

| | | | |
|---|---|---|---|
| 479629 | 12/1951 | Canada | 182/45 |
| 2847275 | 5/1980 | Fed. Rep. of Germany | 248/237 |
| 2384918 | 11/1978 | France | 182/45 |

*Primary Examiner*—Ramon O. Ramirez

[57] ABSTRACT

A safety line anchor device holds a safety line for workmen and is generally intended for use in roof construction. The device is especially useful for use on wood truss roofs of any pitch. The first embodiment of the invention is constructed and arranged for use on one side of a wood truss, 24" centered roof of any pitch. This safety line anchor device comprises a main bar from which fastening straps extend, and at least one anchoring means for holding a safety line. The device is adapted to receive a fastening means, by which it is fixed to a roof. This embodiment can be designed for one or multiple anchor points. A second embodiment of the invention is adapted for use on the peak of a roof and comprises two pivotally joined anchors which straddle the roof peak, each anchor having an anchoring means for holding a safety line attached thereto. A third embodiment is adapted for use on the end peaks of a roof and comprises a pair of supports, each further comprising a central bar from which fastening straps extend, the supports being pivotally joined by a main support to which a safety line anchoring means is attached, from which a safety line may extend down the sides of a house. All embodiments are capable of withstanding a load of at least 5,000 pounds per person. A special hook latch allows only one safety line end to be attached to each anchor point. In addition, a protective shield is used to protect the safety line and the roof from abrasion.

51 Claims, 2 Drawing Sheets

SAFETY LINE ANCHORING DEVICE

BACKGROUND OF THE INVENTION

1. Field of the Invention

This invention relates to roof and house construction and more specifically to a safety line anchoring device for use in holding safety lines for roof construction workers.

2. Description of the Related Art

U.S. Pat. No. 4,249,713 issued Feb. 10, 1981 to Glynn et al discloses an attachment member for roof peaks for holding safety lines for workmen. The device comprises a strip of metal with a central portion 30 and legs 32 provided with openings 33 for receiving nails.

German Patent 2,847,275 discloses a roof ladder safety hook having a ring 9 for rope attachment. The device also has nail holes 4 and 5.

U.S. Pat. No. 4,946,123 issued Aug. 7, 1990 to Albert discloses a roofing bracket having a flat arm for nailing to a roof truss, a cross piece member and a lower support for a beam.

U.S. Pat. No. 1,113,775 issued Oct. 13, 1914 to Gibson discloses a shingling bracket.

U.S. Pat. No. 1,152,685 issued Sep. 7, 1915 to Winn et al discloses a roof scaffold bracket.

U.S. Pat. No. 2,336,144 issued Feb. 4, 1942 to Wickstrom discloses a house-end service attachment.

U.S. Pat. No. 5,054,576 issued Oct. 8, 1991 to Glynn discloses a roof lifeline safety system and anchor assembly therefor, for use on a pitched roof.

U.S. Pat. No. 5,092,426 issued Mar. 3, 1992 to Rhodes discloses a safety device for use on the upper surface of a structure on which a worker is positioned.

Canadian Patent No. 479,629 discloses a device for securing scaffolding for roofers.

French Patent No. 2,384,918 discloses a safety hook for fixing into roof timbering to hold a temporary safety structure.

Although attachment members for holding safety lines exist in the prior art, a need exists for a strong roof bracket for holding safety lines which is easy to assemble, comprising a heavy bar, straps provided with nailing holes and a ring for holding safety lines.

The art described in this section is not intended to constitute an admission that any patent, publication or other information referred to herein is "prior art" with respect to this invention, unless specifically designated as such. In addition, this section should not be construed to means that a search has been made or that no other pertinent information as defined in 37 C.F.R. § 1.56(a) exists.

SUMMARY OF THE INVENTION

The present invention provides a safety line anchor device for holding safety lines for workmen and is generally intended for use in house and roof construction. The device is especially useful for use on wood truss roofs of any pitch. This device can be designed for one or multiple anchor points and also accommodates varying roof pitches and angles. It is most useful for wood truss shingled roofs.

The first embodiment of the invention is constructed and arranged for use on one side of a wood truss, 24" centered roof of any pitch. This safety line anchor device comprises a main bar from which fastening straps extend, and at least one anchoring means for holding a safety line. The device is adapted to receive a fastening means, by which it is fixed to a roof. This embodiment can be designed for one or multiple anchor points.

A second embodiment of the invention is adapted for use on the peak of a roof and comprises two pivotally joined anchors which straddle the roof peak, each anchor having an anchoring means for holding a safety line attached thereto.

A third embodiment is adapted for use on the end peaks of a roof and comprises a pair of main supports, each further comprising a central bar from which fastening straps extend, the central supports being pivotally joined by a main support to which at least one safety line anchoring means is attached, from which a safety line may extend down the side of a house.

All embodiments are readily designable so as to be capable of withstanding a load of at least 5,000 pounds per person. The device can be designed to accommodate loads of lesser or greater magnitude. Each safety line anchoring means is constructed to allow only one safety line to be attached to each anchor point. In addition, a protective shield is used in preferred embodiments to protect the safety line and the roof from abrasion.

BRIEF DESCRIPTION OF THE DRAWINGS

A detailed description of the invention is hereafter described with specific reference being made to the drawings in which.

DESCRIPTION OF THE PREFERRED EMBODIMENTS

The safety line anchor device of the present invention is intended for use on a truss roof of any pitch. The safety line anchor device is especially useful in roof construction for holding a safety line for persons working on a wood truss pitched roof. Where workers are required to be protected from falling by wearing a safety belt, chest harness or full body harness, a safety line, usually a rope or lanyard, is attached to one of these devices. The other end of the safety line is connected to the inventive safety line anchoring device.

Figure 1:
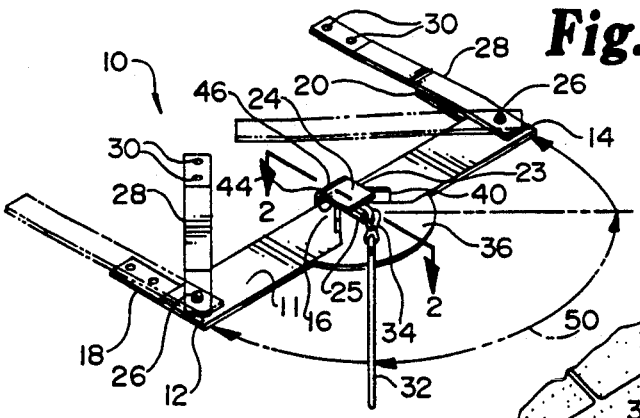
FIG. 1 is a perspective view of a safety line anchor device according to the present invention.
Figure 2:
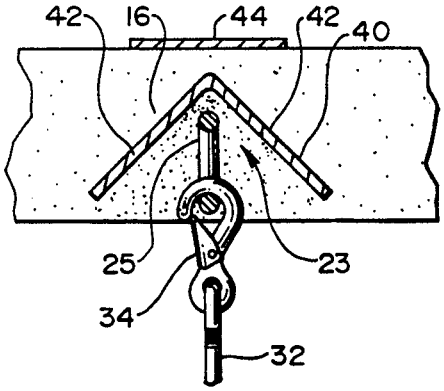
FIG. 2 is a sectional view thereof taken along line 2—2.

Referring to FIGS. 1 and 2, the safety line anchor bar, generally indicated at 10 comprises a main bar 11 having opposite ends 12 and 14 and a central portion 16. Fastening straps 18 and 20 are fixed to ends 12 and 14, respectively. Main bar 11, and fastening straps 18 and 20 are made of any suitable material, preferably metal. In its most preferred embodiment, main bar 11 is ⅜" thick and 3" wide. Fastening straps 18 and 20, may be molded, welded, bolted or affixed to main bar 11 by any suitable means.

Anchoring point 23 is permanently fixed to main bar 11 at center 16, and as shown in FIG. 2, comprises a loop 25 extending upwardly from main bar 11. Loop 25 may be a chain link welded to bar 11 to form a loop extending from the surface of main bar 11. Anchoring point 23 further includes a housing 24 comprising a piece of angle iron 40 welded to bar 11 to form sides 42 of housing 24, and an additional piece of angle iron 44 welded to the surface of main bar 11 to form a ceiling 46 for housing 24.

Figure 3:
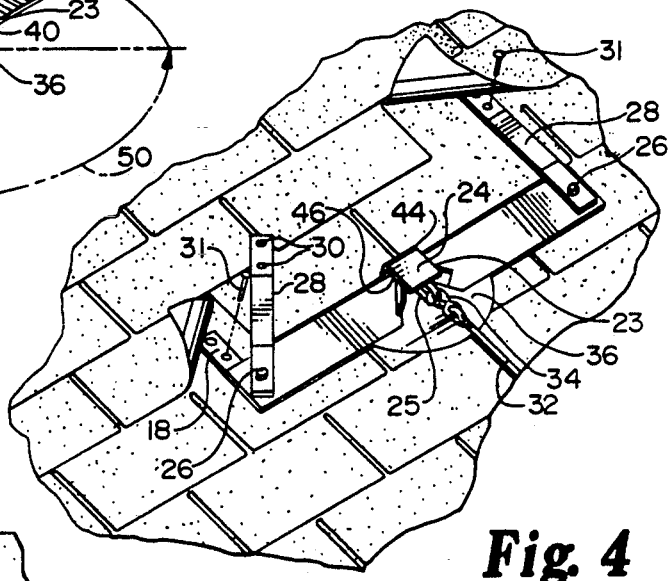
FIG. 3 is a perspective view thereof in process.

As shown in FIG. 3, stacking fastening straps 28 are affixed to main bar 11 by means of a welded bolt assembly 26 extending through main bar 11 and fastening straps 18 and 20. Stacking fastening straps 28 are layered over fastening straps 18 and 20 for being fastened to the roof at a higher point, or where the roof has shingles, to successively higher rows of shingles on the roof. Due to the use of bolt assembly 26, the straps are rotatable in and out of the stacking arrangement to allow access to each strap for fastening. Alternatively, additional stacking fastening straps may be used, for extra strength, depending on roof size. Fastening straps 18, 20, 22 and 28 have fastener receiving means associated therewith. In the most preferred embodiment the fastener receiving means are three nail holes 30 which receive nails 31. Fastening straps 18, 20, 22, and 28 are nailed to the roof underneath the shingles, thereby affixing the safety line anchoring device 10 to the roof.

In use, fastening straps 18 and 20 are positioned directly over trusses and underneath a top layer of shingles, if shingles have been installed already. Stacking fastening straps 28 are pivoted to expose fastening straps 18 and 20, which are then fastened to the roof. In the most preferred embodiment, the fastening means 31 are nails. The shingle layer is then layered back over straps 18 and 20. Fastening straps 28 are then swung back in line with straps 18 and 20, underneath the next successively higher layer of shingles. Straps 28 are then fastened beneath a lifted shingle, etc. Multiple layers of straps are required may be used in this fashion. Two or three are usually adequate.

The layered fastening straps are able in most cases to slide underneath existing shingles, which allows for nailing only through the lower shingle leaving the top shingle unpunctured. The fixed fastening straps are nailed into the trusses, then the remaining swiveling layered straps are swung up into the same position and nailed above the fixed straps, providing extra holding power and minimal shingle disturbance.

Rope 32 is attached at one end to safety clamp 34. Clamp 34 attaches to bar 11 at anchoring point 23. Rope 32 acts as a safety line for workers, the other end of the rope being attached to a worker's harness. Loop 25 of anchoring point 23 provides a means by which clamp 34 is attached. Anchoring point 23 further provides a safety feature in that only one safety clamp will fit in loop 25 beneath ceiling 46. In addition, as is shown in FIGS. 1 and 3, protective shield 36 is attached to and extends from anchor housing 24 bar 11 is used to protect the rope from abrasion as well as protecting existing shingles. Shield 36 may be made of plastic or any suitable material which is protective of the roof top.

Figure 4:
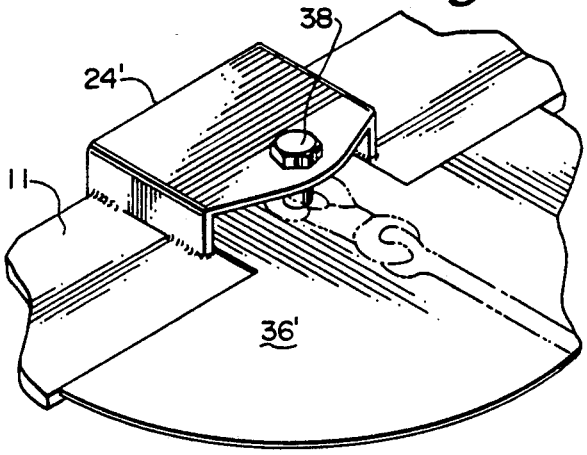
FIG. 4 is an enlarged perspective view of an alternative embodiment of the safety-line anchor.

Alternatively, as shown in FIG. 4, housing 24' may be a single piece welded to bar 11 which includes a bolt 38 extending through housing 24' to the back of bar 11 and is permanently affixed by welding protective shield 36. Again, each anchoring point preferably accommodates only one safety clamp. Full protection is provided in the area indicated by arrow 50.

Figure 5:
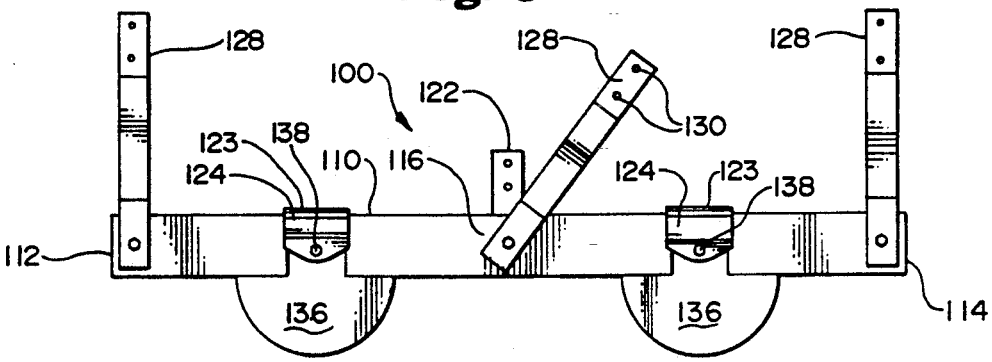
FIG. 5 is a top plan view of an alternative embodiment of the invention.

The bar shown in FIGS. 1 and 3 is suitable for use by one person. Referring now to FIG. 5, an alternative embodiment of the invention for use by two people, shown generally at 100, includes two anchoring points 123, one for each person. Bar 100 has opposite ends 112 and 114 and a central portion 116. Fastening straps 118 and 120 are welded to ends 112 and 114, respectively. Fixed central fastening strap 122 is welded to bar 100 at center 116. Layered fastening straps 128 are longer than fastening straps 118, 120, and 122 such that straps 128 may be fastening to a successively higher row of shingles on a roof. Straps 128 are pivotally mounted by means of a permanently welded nut and bolt assembly. Although one layering strap per fixed fastening strap is most preferred, any number of layered straps may be used, depending on roof size. Layered straps of increasing lengths may be layered over each other for being fastened to successively higher rows of shingles on the roof. Fastening straps 118, 120, 122, and 128 have three nail holes 130 by which the straps are fastened to the roof underneath the shingles, thereby affixing bar 100 to the roof.

Anchoring points 123 are preferably permanently fixed to bar 100 between center 116, and each end 112 and 114. Either embodiment of the safety line anchor as shown in FIGS. 1 and 3 or as shown in FIG. 4, may be used. The embodiment shown is the unitary housing, as shown in FIG. 4, including a housing 124 with a bolt 138 and a safety shield 136.

Bolt 138 of anchoring point 123 provides a means by which a safety clamp holding a safety line is attached to the anchoring device, as shown in FIGS. 1–4. Housing 124 further provides a safety feature in that only one safety clamp will fit in housing 124 on bolt 138. Protective shield 136 is attached to and extends from anchor housing 124 and protects the rope and existing shingles from abrasion. Again, each anchoring point preferably accommodates only one safety clamp, and meets OSHA safety regulations.

In use, bar 110 is laid on a roof and fastening straps 118, 120 (as shown in FIG. 1) and 122 are positioned directly over trusses and underneath a top layer of shingles, if shingles have been installed. Stacking fastening straps 128 are pivoted to expose fastening straps 118, 120 and 122, which are then fastened to the truss supporting the roof. The straps are spaced on the bar to align with standard spacing and roof construction. The shingle layer is then layered back over straps 118, 120 and 122. Fastening straps 128 are then swung back in line with straps 118, 120 and 122, and fastened at a higher point on the roof. Where shingles have been installed, fastening straps 128 are slid underneath the next successively higher layer of shingles. The straps are easily slid between shingles. Straps 128 are then fastened beneath the lifted shingle. Thus, attachment of the safety bar to the roof is possible without putting holes in the shingles.

The embodiments shown thus provide a strong reliable means of connecting a safety rope to a roof, without damaging the shingles. The safety bar may be used before or after the shingles are installed. The device may also accommodate one worker, two workers or more than two if necessary, by providing additional anchors. These embodiments are suitable for use on one side of a wood truss (24" centered) roof of any pitch and are adjustable to other truss spacing. This design features flat and overlapping fastening straps which slide underneath existing shingles. This allows for fastening only through the lower shingle, leaving the top shingle unpunctured and providing safe extra holding power with minimal shingle disturbance. This bar may be manufactured with one or multiple anchor points depending on the width of the bar, as a wider bar would cover more trusses, thereby providing more strength. Alternatively, additional strength could be provided by using additional layering fastening straps.

Although useful on all pitched roofs, these embodiments are ideally suited to be used on top of wood truss or pitched roofs with shingles. The thin fastening straps are easily slid between shingles and may be spaced out for 24" covered trusses. Trusses may be located with the use of a stud finder. Fastening straps may be nailed down with duplex (double headed) 16 penny sinkers (nails), for easier removal. The anchoring device is able to withstand a load of at least 5,000 lbs. per person. This is necessary as shown to assure security in a life threatening situation. When multiple anchor points are present, the device is rated accordingly, to at least 5,000 per person.

Figure 6:
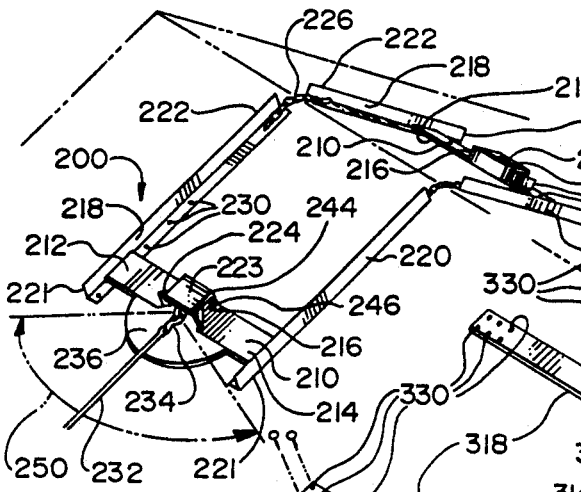
FIG. 6 is a perspective view of an alternative embodiment of the invention.

Referring now to FIG. 6, an additional embodiment of the invention is shown at 200, wherein the safety line anchor bar comprises two main bars 210 having opposite ends 212 and 214 and a central portion 216. Fixed fastening straps 218 and 220 having proximal and distal ends 221, and 222. Fastening straps 218 and 220 are fixed to ends 212 and 214, respectively, and extend perpendicularly in both directions from each end. Anchoring points 223 are fixed to bars 210 at center 216, and each comprise a loop 225 extending upwardly from bar 210. Loop 225 may be a chain link welded to bar 210 to form a loop extending from the surface of bar 210. Anchoring point 223 further includes a housing 224 comprising a piece of angle iron 240, or the like, welded to bar 210 to form sides 242 of housing 224, and an additional piece of angle iron 244, or the like, welded to the surface of bar 210 to form a top cover 246 for housing 224.

Safety line 232 is attached at one end to safety clamp 234. Clamp 234 attaches to bar 210 at anchoring point 223. The other end of safety line 232 is attached to a worker's harness. Loop 225 of anchoring point 223 provides a means by which clamp 234 is attached. Housing 224 further provides a safety feature in that only one safety clamp will fit in housing 224 on loop 225. Protective shield 236 is attached to and extends from anchor housing 224 and protects the rope and existing shingles from abrasion. Alternatively, the safety line anchor may be as shown in FIG. 4, and described above.

Fastening straps 218 and 220 may be molded, welded, bolted or otherwise securely affixed to bar 210 by any suitable means, although welding is most preferred. The two safety bars are joined by a pivoting means 226 attached to distal ends 222 of nailing straps 218 and 220. In the embodiment shown in the Figures, the pivot means is a length of chain. As shown in FIG. 6, safety line anchor 200 straddles the peak of a two sided roof peak. Therefore, the roof peak straddle anchor features two safety line anchor points, one per each side of the roof. The two halves hinge so as to accommodate any pitched roof. Fall protection is therefore provided only in the range indicated by arrow 250. Fastener receiving means 230 of fastening straps 218 and 220 allow for standard 16d sinker nails or preferably duplex nails (double headed nails) for easy removal. Fastener receiving means 230 must be centered over the truss. This device is exactly 24" wide between fastener receiving means 230 of fastening straps 218 and 220 in the embodiment shown, which corresponds to 24" centered trusses, the industry standard. Other sizes for other standards may be readily achieved. The use of a stud finder may be necessary to locate the studs in order to properly install the safety rope anchor.

Figure 7:
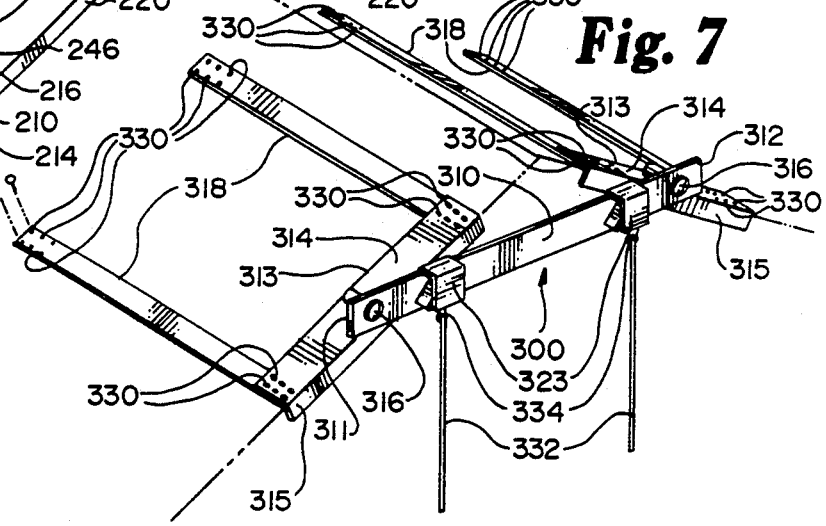
FIG. 7 is a perspective view of an alternative embodiment of the invention.
Figure 8:
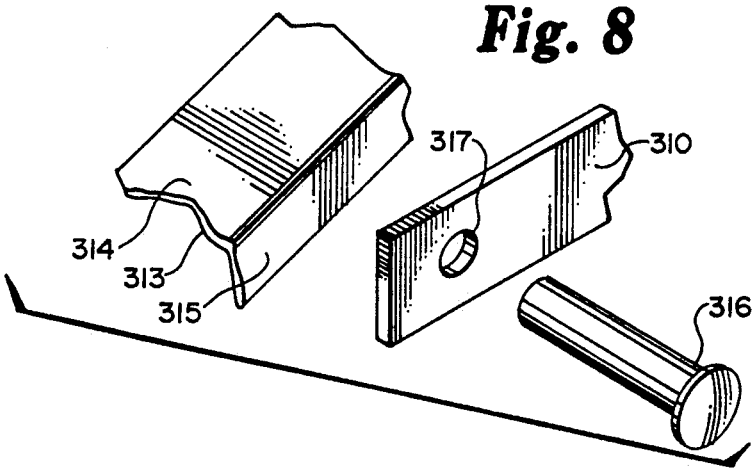
FIG. 8 is an exploded view thereof of the pivot of FIG. 7.

An additional embodiment of the invention, as shown in FIGS. 7–8 is a safety line anchor device, shown generally at 300, for use on the end peaks of a wood trussed, two sided, peaked roof. This embodiment features a main bar 310 having two opposite ends 311 and 312 and two central bars 313. In the most preferred embodiment, the central bars are angle irons 313 having a top side 314 and a front side 315. Angle irons 313 are mounted to main bar 310 by pivot pins 316 welded to top side 314 of each angle iron. Pivot 316 fits through pivot 317, better seen in FIG. 8, located at each end of main bar 310 and are permanently flanged to secure angle irons 313 to main bar 310 while allowing them to pivot. This feature compensates for different pitched roof lines. Two metal nailing bars 318 are attached to each angle iron 313. Fastening bars 318 have fastener receiving means 330 and are used to fasten safety line anchoring device 300 into the underlying trusses. Angle irons 313 are fastened into the end truss as well. These angle irons 313 serve to reinforce the edge of the roof lines as well as minimize any twisting of the main bar under load.

Anchoring points 323 are permanently fixed to main bar 310 at ends 311 and 312, adjacent pins 316. The anchoring point 323, is best shown in FIGS. 1 and 2.

Safety lines 332 are attached at one end to safety clamp 334. Clamp 334 attaches to central bar 310 at anchoring point 323. Ropes 332 act as safety lines for workmen, the other end of the ropes being attached to a worker's harness. Housing 324 further provides a safety feature in that it is sized so that only one safety clamp will fit in housing 324. An alternative embodiment of the safety line anchoring point is shown in FIG. 4. A protective shield may optionally be included at the anchoring point.

There are several advantages of the safety rope anchor bars of the present invention. The present invention provides a strong, reliable means of mounting a safety rope to a roof, in most cases without damaging the shingles. The device may be used before or after the shingles are installed. Further, the bar can be manufactured to accommodate one worker, two workers, or more than two if necessary.

An additional advantage of the present invention is its safety rating. The one open person unit is rated for 5,200 lbs. shock, or for one man if a 6' straight fall is possible. All other units are rated for at least 5,000 lbs. per person, pursuant to OSHA (Occupational Safety and Health Administration) standards. The present invention provides safety rope anchor bars for use with a wide variety of roof shapes and sizes.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A safety line anchoring device for securing a safety line to a truss roof of any pitch, said anchoring device comprising:

a main bar having an upper surface and a lower surface, two opposite sides, two opposite ends and a central portion;

a plurality of fastening straps having proximal and distal ends, each of said fastening straps being attached to and extending substantially perpendicularly from the main bar, each fastening strap having a plurality of nail holes associated therewith; and at least one safety line anchoring means permanently fixed to the main bar to which a safety line may be removably secured; whereby the lower surface of the main bar is placed on a roof and the fastening straps are fastened to the roof by nails which are driven through the nail holes to affix the safety line anchoring device to the roof.

2. The safety line anchoring device of claim 1 wherein the fastening straps comprise a pair of stationary members, one of each being disposed at each end of the main bar respectively.

3. A safety line anchoring device for securing a safety line to a truss roof of any pitch, said anchoring device comprising:

a main bar having an upper surface and a lower surface, two opposite sides, two opposite ends and a central portion;

a plurality of stationary fastening straps having proximal and distal ends, each of said fastening straps being attached to and extending substantially perpendicularly from the main bar, each fastening strap having a plurality of fastener receiving means associated therewith, at least one fastening strap being fixed at each end and at the central portion of the main bar;

a plurality of stacking fastening straps pivotally attached to the main bar such that at least one stacking fastening strap is mounted over a stationary fastening strap, each of said stacking fastening straps being longer than the stationary fastening straps and having a plurality of fastener receiving means associated therewith; and at least one safety line anchoring means permanently fixed to the main bar to which a safety line may be removably secured; whereby the lower surface of the main bar is placed on a roof, the stationary fastening straps are fastened to the roof by a fastening means and the stacking fastening straps are pivoted over the stationary fastening straps and fastened to the roof by a fastening means, thereby mounting the anchoring device to the roof.

4. The safety line anchoring device of claim 3 further including a protective shield attached to and extending from the anchoring means to protect the safety line and the roof from abrasion.

5. The safety line anchoring device of claim 3 wherein the fastener receiving means are located at the distal end of the stationary and stacking fastening straps.

6. The safety line anchoring device of claim 4 constructed and arranged for use on a wood truss shingled roof of any pitch, wherein the fastening straps are adapted to be nailed beneath a row of shingles, and the stacking fastening straps are pivoted over the fastening straps and adapted to be nailed into a next successively higher row of shingles.

7. The safety line anchoring device of claim 4 wherein the stacking fastening straps are pivotally mounted to the main bar.

8. The safety line anchoring device of claim 4 wherein each end of the main bar is located at a truss of the roof, such that each fastening strap may be nailed to a truss.

9. The safety line anchoring device of claim 4 wherein the safety line anchoring means comprises:

a V-shaped housing made of a piece of angle iron welded to the surface of the main bar, the housing having two perpendicular side walls extending upwardly from the surface of the main bar;

a loop extending upwardly from the surface of the main bar, the loop comprising a chain link welded to the surface of the bar located between the side walls such that the loop bisects the 90° angle made by the side walls; and a cover extending over the side walls and the loop, said cover comprising an additional piece of angle iron welded to the side of the main bar such that it extends over the side walls and the loop.

10. The safety line anchoring device of claim 9 further including a safety line having two ends, a safety clamp attached to one end of the safety line, the safety clamp being attached to the loop of the safety line anchoring means, and a safety harness attached to the other end of the safety line.

11. The safety line anchoring device of claim 4 wherein the safety line anchoring means comprises a unitary housing welded to the main bar and a bolt extending through the housing to the back of bar, said bolt being permanently affixed by welding.

12. The safety line anchoring device of claim 9 or claim 11 wherein the protective shield is mounted to the safety line anchoring means, a curved portion thereof extends from the side of the main bar, said protective shield being made of plastic.

13. A safety line anchoring device for securing a safety line to a truss shingled roof of any pitch, said anchoring device comprising:

a main bar having an upper surface and a lower surface, two opposite sides, two opposite ends and a central portion;

a plurality of stationary fastening straps having proximal and distal ends, said fastening straps extending substantially perpendicularly from the main bar;

at least one fastening strap being attached to each end and the central portion of the main bar, each of said fastening straps having a plurality of nail holes located at the distal end thereof;

a plurality of stacking fastening straps pivotally attached to the main bar such that at least one stacking fastening strap is mounted over a stationary fastening strap, each of said stacking fastening straps being longer than the stationary fastening straps and having a plurality of nail holes located at the distal end thereof;

at least one safety line anchoring means fixed to the main bar to which a safety line may be removably secured; and a protective shield attached to and extending from the anchoring means to protect the safety line and the shingled roof from abrasion, whereby the lower surface of the main bar is placed on a roof, the stationary fastening straps are nailed into the roof beneath a row of shingles and the stacking fastening straps are pivoted over the stationary fastening straps and nailed into a next successively higher row of shingles, thereby mounting the anchoring device to the roof.

14. The safety line anchoring device of claim 13 wherein the safety line anchoring means comprises a unitary housing welded to the main bar and a bolt extending through the housing to the back of bar, said bolt being permanently affixed by welding.

15. The safety line anchoring device of claim 13 wherein each end of the main bar is located at a truss of the roof, such that each fastening strap may be nailed to a truss.

16. The safety line anchoring device of claim 13 wherein the safety line anchoring means comprises:

a V-shaped housing made of a piece of angle iron welded to the surface of the main bar, the housing having two perpendicular side walls extending upwardly from the surface of the main bar;

a loop extending upwardly from the surface of the main bar, the loop comprising a chain link welded to the surface of the bar located between the side walls such that the loop bisects the 90° angle made by the side walls; and a cover extending over the side walls and the loop, said cover comprising an additional piece of angle iron welded to the side of the main bar such that it extends over the side walls and the loop.

17. The safety line anchoring device of claim 16 or claim 14 wherein the protective shield is mounted to the safety line anchoring means, a curved portion thereof extends from the side of the main bar.

18. A safety line anchoring device for use on the peak of a roof of any pitch, for securing at least one safety line to the roof for use in roof construction, said anchoring device comprising:

a first safety line anchor comprising:

a first main bar having an upper surface, a lower surface, two opposite sides, two opposite ends and a central portion, a first pair of fastening straps, each strap having proximal and distal ends, each of said fastening straps being respectively attached to each end of the first main bar, such that the proximal ends of the fastening straps and the distal ends of the fastening straps extend substantially perpendicularly in opposite directions from the first main bar, the proximal ends being shorter in length than the distal ends;

a plurality of fastener receiving means associated with each fastening strap, and a safety line anchoring means fixed to the first main bar at the central portion thereof;

a second safety line anchor comprising:

a second main bar having an upper surface, a lower surface, two opposite sides, two opposite ends and a central portion, a second pair of fastening straps, each strap having proximal and distal ends, each of said fastening straps being respectively attached to each end of the second main bar, such that the proximal ends of the fastening straps and the distal ends of the fastening straps extend perpendicularly in opposite directions from the second main bar, such that the proximal ends are shorter in length than the distal ends, a plurality of fastener receiving means associated with each fastening strap, and a safety line anchoring means fixed to the second main bar at the central portion thereof; and a pivot means joining the first and second safety line anchors, said pivot means extending between the distal ends of the fastening straps of each safety line anchor, whereby the safety line anchor device may be placed on a roof, straddling a roof peak and affixed thereto by a plurality of fastening means.

19. The safety line anchoring device of claim 18 wherein the pivot means is a chain.

20. A safety line anchoring device as in claim 18 wherein the fastener receiving means are nail holes and the fastening means are nails, which are driven through the nail holes to affix the safety line anchoring device to the roof.

21. A safety line anchoring device as in claim 20 wherein the fastening straps are permanently fixed to the first and second main bars.

22. The safety line anchoring device of claim 18 further including a protective shield attached to and extending from the anchoring means to protect the line and the roof from abrasion.

23. The safety line anchoring device of claim 22 wherein the safety line anchoring means comprises a unitary housing welded to the main bar and a bolt extending through the housing to the back of bar, said bolt being permanently affixed by welding.

24. The safety line anchoring device of claim 22 wherein the safety line anchoring means comprises:

a V-shaped housing made of a piece of angle iron welded to the surface of the main bar, the housing having two perpendicular side walls extending upwardly from the surface of the main bar;

a loop extending upwardly from the surface of the main bar, the loop comprising a chain link welded to the surface of the bar located between the side walls such that the loop bisects the 90° angle made by the side walls; and a cover extending over the side walls and the loop, said cover comprising an additional piece of angle iron welded to the side of the main bar such that it extends over the side walls and the loop.

25. The safety line anchoring device of claim 24 or claim 23 wherein a protective shield is mounted to the safety line anchoring means, a circular portion thereof extends from the side of the main bar.

26. The safety line anchoring device of claim 25 constructed and arranged for use on a wood truss shingled roof.

27. A safety line anchoring device for use on the peak of a wood truss shingled roof of any pitch, for securing at least one safety line to the roof for use in roof construction, said anchoring device comprising:

a first safety line anchor comprising:

a first main bar having an upper surface, a lower surface, two opposite sides, two opposite ends and a central portion, a first pair of fixed fastening straps, each fixed fastening strap having proximal and distal ends, said fixed fastening straps being fixed to each end of the first main bar, such that the proximal ends of the fixed fastening straps and the distal ends of the fixed fastening straps extend perpendicularly in opposite directions from the first main bar, such that the proximal ends are shorter in length than the distal ends, a plurality of fastener receiving means associated with each fixed fastening strap, a safety line anchoring means fixed to the first main bar at the central portion thereof, and a protective shield attached to and extending from the anchoring means to protect the line and the shingled roof from abrasion;

a second safety line anchor comprising:

a second main bar having an upper surface, a lower surface, two opposites sides, two opposite ends and a central portion, a second pair of fixed fastening straps, each fixed fastening strap having proximal and distal ends, said fixed fastening straps being permanently fixed to each end of the second main bar, such that the proximal ends of the fixed fastening straps and the distal ends of the fixed fastening straps extend substantially perpendicularly in opposite directions from the second main bar, such that the proximal ends are shorter in length than the distal ends, a plurality of fastener receiving means associated with each fixed fastening strap, a safety line anchoring means fixed to the second main bar at the central portion thereof, and a protective shield attached to and extending from the anchoring means to protect the line and the shingled roof from abrasion; and a pivot means joining the first and second safety line anchors, said pivot means extending between the distal ends of the fixed fastening straps of each safety line anchor, whereby the safety line anchor device may be placed on a roof, straddling a roof peak and affixed to the roof by a plurality of fastening means.

28. The safety line anchoring device of claim 27 wherein the safety line anchoring means comprises a unitary housing welded to the main bar and a bolt extending through the housing to the back of bar, said bolt being permanently affixed by welding.

29. A safety line anchoring device as in claim 27 wherein the fastening means are nails and the fastener receiving means are nail holes located on the fastening straps.

30. The safety line anchoring device of claim 27 wherein the pivot means is a chain.

31. The safety line anchoring device of claim 27 wherein the safety line anchoring means comprises:

a V-shaped housing made of a piece of angle iron welded to the surface of the main bar, the housing having two perpendicular side walls extending upwardly from the surface of the main bar;

a loop extending upwardly from the surface of the main bar, the loop comprising a chain link welded to the surface of the bar located between the side walls such that the loop bisects the 90° angle made by the side walls; and a cover extending over the side walls and the loop, said cover comprising an additional piece of angle iron welded to the side of the main bar such that it extends over the side walls and the loop.

32. The safety line anchoring device of claim 31 or claim 28 wherein the a circular portion of the protective shield mounted to the safety line anchoring means extends from the side of the main bar.

33. A safety line anchoring device for use on the end peaks of a roof, for securing at least one safety line to the roof, said anchoring device comprising:

a pair of central supports, each comprising:

a main bar having an upper surface, a lower surface, two opposite sides, two opposite ends and a central portion, a pair of fastening straps, each fastening strap having proximal and distal ends, the proximal end of said fastening straps being attached to each end of the central bar, such that the fastening straps extend perpendicularly from the central bar, and a plurality of fastener receiving means associated with each fastening strap and the central bar;

a main support bar having an upper surface, a lower surface, two opposite sides, two opposite ends and a central portion;

a pivot means located at the central portion of the central bar of each support;

an opening located at each end of the main bar, each said opening being adapted to receive the pivot means; and a safety line anchoring means fixed at each end of the main bar, adjacent the pivot means;

whereby the main bar is pivotally connected at each end to the center portion of the central bar of each support, thereby pivotally joining the supports, the safety line anchor device being placed on an end peak of a roof, straddling the roof peak and being affixed to the roof by a plurality of fastening means.

34. The safety line anchoring device of claim 33 wherein the safety line anchoring means comprises a unitary housing welded to the main bar and a bolt extending through the housing to the back of the main bar, said bolt being permanently affixed by welding.

35. The safety line anchoring device of claim 33 wherein the fastener receiving means are located at the distal ends of each fastening strap and at each end of each central bar.

36. The safety line anchoring device of claim 33 wherein the fastener receiving means are nail holes and the fastener means are nails which are driven through the nail holes to affix said safety line anchoring device to the roof.

37. The safety line anchoring device of claim 33 wherein the fastening straps are fixed to the central bars.

38. The safety line anchoring device of claim 33 further including a protective shield attached to and extending from the safety line anchoring means to protect the safety line and the roof from abrasion.

39. The safety line anchor device of claim 33 wherein the central bar of each support further comprises an angle iron with an upper edge and a front edge and each pivot means comprises a large bolt which is fitted through the opening located at each end of the main bar, and is then fixed to the central portion of the upper edge of the angle iron, whereby the main bar is allowed to pivot on the bolts.

40. The safety line anchoring device of claim 33 wherein the safety line anchoring means comprises:

a V-shaped housing made of a piece of angle iron welded to the surface of the main bar, the housing having two perpendicular side walls extending upwardly from the surface of the main bar;

a loop extending upwardly from the surface of the main bar, the loop comprising a chain link welded to the surface of the main bar located between the side walls such that the loop bisects the 90° angle made by the side walls; and a cover extending over the side walls and the loop, said cover comprising an additional piece of angle iron welded to a side of the main bar such that it extends over the side walls and the loop.

41. The safety line anchoring device of claim 33 wherein the protective shield is mounted to the safety line anchoring means and a circular portion thereof extends from the side of the main bar.

42. The safety line anchoring device of claim 41 constructed and arranged for use on a house with a wood trussed two sided, peaked, shingled roof.

43. A safety line anchoring device for use on the end peaks of a roof, for securing at least one safety line to the roof, said anchoring device comprising:

a pair of supports, each comprising:

a central bar having an upper surface, a lower surface, two opposite sides, two opposite ends and a central portion, a pair of fixed fastening straps, each fixed fastening strap having proximal and distal ends, the proximal end of said fixed fastening straps being fixed to each end of the each central bar, such that the fixed fastening straps extend perpendicularly from each central bar, and a plurality of fastener receiving means associated with the fastening straps and the central bars;

a main bar having an upper surface, a lower surface, two opposite sides, two opposite ends and a central portion;

a pivot means located at the central portion of the central bar of each support;

an opening located at each end of the main bar, each said opening being adapted to receive the pivot means;

a safety line anchoring means fixed at each end of the main bar, adjacent the pivot means; and a protective shield attached to and extending from the safety line anchoring means to protect the safety line and the roof from abrasion; whereby the main bar is pivotally connected at each end to the central portion of the main bar of a support, thereby pivotally joining the main supports, the safety line anchor device being placed on an end peak of a roof, straddling the roof peak and being affixed to the roof by a plurality of fastening means

44. The safety line anchoring device of claim 43 wherein the safety line anchoring means comprises a unitary housing welded to the main bar and a bolt extending through the housing to the back of the main bar, said bolt being permanently affixed by welding.

45. The safety line anchoring device of claim 43 wherein the fastener receiving means are located at the distal ends of each fastening strap and at each end of each central bar.

46. The safety line anchoring device of claim 43 wherein the fastener receiving means are nail holes and the fastening means are nails which are driven through the nail holes to affix said safety line anchoring device to the roof.

47. The safety line anchoring device of claim 43 for use on a wood trussed two sided, peaked, shingled roof.

48. The safety line anchor device of claim 43 wherein the central bar of each support further comprises an angle iron with an upper edge and a front edge and each pivot means comprises a large bolt which is fitted through the opening located at each end of the main bar, and is then permanently attached to the central portion of the upper edge of the angle iron, whereby the main bar is allowed to pivot on the bolts.

49. The safety line anchoring device of claim 43 wherein the safety line anchoring means comprises:

a V-shaped housing made of a piece of angle iron welded to the surface of the main bar, the housing having two perpendicular side walls extending upwardly from the surface of the main bar;

a loop extending upwardly from the surface of the main bar, the loop comprising a chain link welded to the surface of the main bar located between the side walls such that the loop bisects the 90° angle made by the side walls; and a cover extending over the side walls and the loop, said cover comprising an additional piece of angle iron welded to a side of the main bar such that it extends over the side walls and the loop.

50. The safety line anchoring device of claim 49 or claim 44 wherein the protective shield is mounted to the safety line anchoring means, a circular portion thereof extends from the side of the main bar.

51. The safety line anchoring device of claim 50 constructed and arranged for use on a house with a wood trussed two sided, peaked, shingled roof.

* * * * *